United States Patent [19]

Stanton

[11] Patent Number: 4,501,119

[45] **Date of Patent: * Feb. 26, 1985**

[54] PUMP JACK

[75] Inventor: George E. Stanton, Orient, Ohio

[73] Assignee: NuJack Oil Pump Company, Columbus, Ohio

[ * ] Notice: The portion of the term of this patent subsequent to Jul. 24, 2001 has been disclaimed.

[21] Appl. No.: 470,587

[22] Filed: Feb. 28, 1983

[51] Int. Cl.[3] ..... F15B 13/04

[52] U.S. Cl. ..... 60/398; 74/41; 91/277; 91/397; 60/370; 92/13.7

[58] Field of Search ..... 74/41, 519, 522, 525; 91/277, 397, 417 R; 60/369, 370, 371, 372, 398; 92/13.7; 403/104, 109, 300, 305, 306, 362, 377

[56] References Cited

U.S. PATENT DOCUMENTS

| | | | |
|---|---|---|---|
| 1,494,768 | 5/1924 | Bloss et al. | 74/522 |
| 1,699,675 | 1/1929 | Reschke | 74/41 |
| 2,074,550 | 3/1937 | Humphrey | 74/41 |
| 2,098,290 | 11/1937 | Hinkle et al. | 74/519 |
| 2,187,659 | 1/1940 | Lane | 74/522 |
| 2,704,998 | 3/1955 | Day et al. | 74/41 |
| 3,365,624 | 1/1968 | Komendera | 91/275 |
| 3,971,213 | 7/1976 | Kelley | 60/372 |

*Primary Examiner*—Robert E. Garrett
*Assistant Examiner*—Richard S. Meyer
*Attorney, Agent, or Firm*—Sidney W. Millard

[57] ABSTRACT

A pump jack of the type comprising a rocker arm pivotably mounted intermediate its ends on a support member, said rocker arm being divided by said pivot mounting into a sucker-rod limb and a drive limb wherein the improvement comprises a pneumatic motor pivotably attached to the drive support member and further pivotably attached to the mounting base of the pump jack to provide the power to reciprocate the pump jack. The working fluid of said pneumatic motor being natural gas which is available from the well casing of the well without any interference with the flow of the oil in the oil tube of the well thereby making use of an energy source available at any oil well without having to provide gasoline to drive a rotating type gasoline engine or electricity to drive an electric motor usually of the rotating variety. Also the stroke of a pneumatic cylinder inherently smooths out and eliminates the shock loading at the extremes of motion at the piston mounted to the sucker rods of such pump jack at the bottom of the well.

13 Claims, 2 Drawing Figures

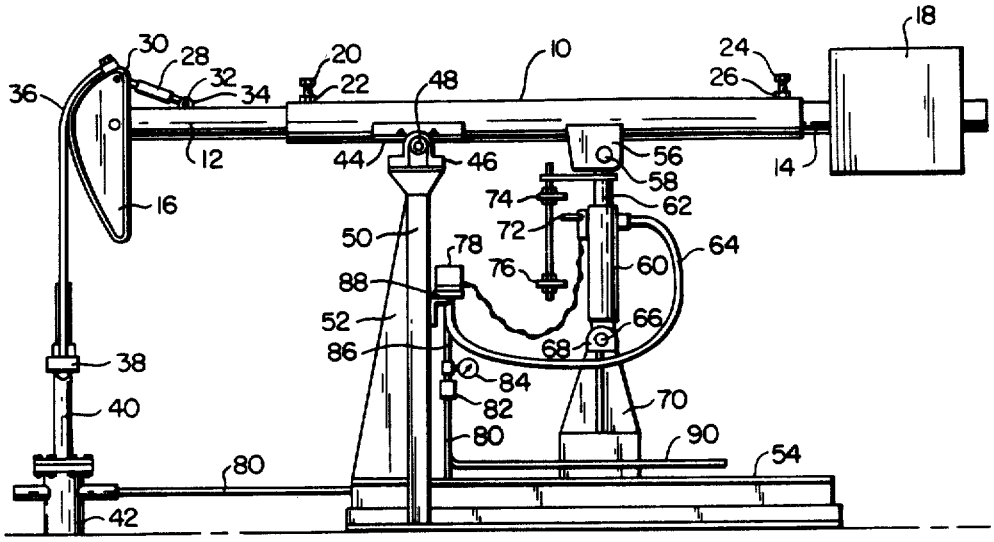
FIG. 1
FIG. 2
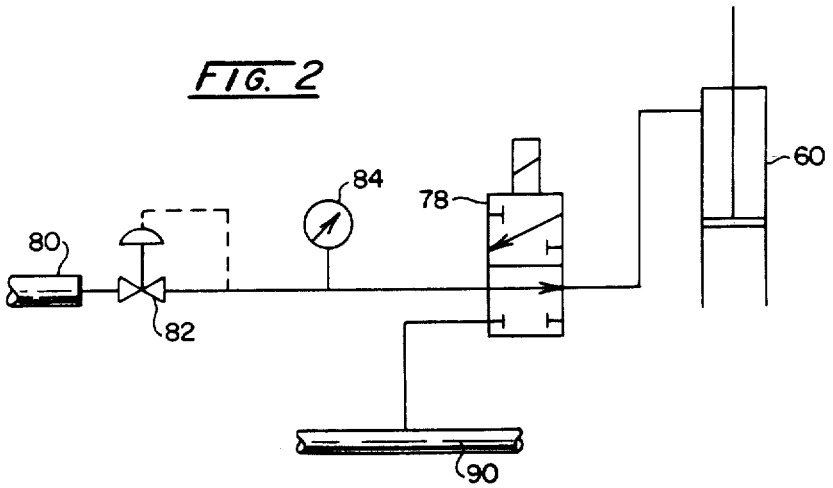

PUMP JACK

BACKGROUND OF THE INVENTION

The invention relates to a pump jack for use in pumping liquids, and more specifically to a pump jack for pumping oil from ground wells. The invention also relates to utilizing resources available at the well head to provide the energy, and motive power required to operate a pump jack.

Conventional pump jacks for pumping various liquids generally comprise a rocker arm pivotally mounted intermediate its ends on a main support member. On one limb (hereinafter referred to as the sucker-rocker limb) of this rocker arm the sucker rods are attached by flexible means to a typical "horsehead" and assembly specifically designed to maintain the sucker rods in vertical alignment within the well. The sucker rods which descend into the well are connected to the piston and pump which are mounted within the well near the bottom or at the level at which the liquid to be pumped is located. Usually, a counterweight is mounted on the opposed limb of the rocker arm (hereinafter referred to as the drive limb) to counter balance the greater weight of the sucker rod and piston assembly. To pivot the rocker arm and thus to reciprocate the sucker rods vertically within the well, the upper end of a motor driven mechanism is mounted fixedly to the drive limb of the rocker arm. Such a motor assembly is usually of the rotary type, and the rotation of a drive shaft mounted to a motor causes the sucker rod to reciprocate in a vertical direction as measured by the motion at the horsehead. Such a motor is either electrical or gasoline driven, in either case requiring attention to the provision of a source of energy either providing gasoline or other burnable hydrocarbon or the running of electrical wires to what is potentially a remote location.

An additional problem that is involved with such a motor driven type of pump jack is that the rotary motion of a motor be it electrical or gasoline driven is at considerably higher shaft speed than the desired speed at which the horsehead is intended to be reciprocated. Therefore, reducing speed, principally by gear reduction or other lever arm type reduction mechanism, and controlling of the speed itself by governors on the motor constitute built-in mechanical inefficiency since the efficiency of such gear reduction and multiple lever connections removes some of the energy available for driving the pump jack in the appropriate reciprocating manner.

In order to correctly operate such a rocker arm type of pump jack a counter weight is mounted on the drive limb of the rocker arm as was mentioned above. The purpose of a counter weight is to offset the considerably larger weight of the piston sucker rods and also of the column of oil residing above the piston which is being lifted by the motion of the pump jack. Such counterweighting systems can be of the over counterweighted or under counterweighted type. An over counterweighted system is one in which the counterweight more than compensates for the weight of the oil, the piston, the sucker rods, and the horsehead in addition to the weight of the sucker rod limb of the rocker arm such that when all power is removed from the system the counterweight will pull the piston to its uppermost position within the well. In such a system the force on the drive limb of the rocker arm tends to push the counterweighted drive limb in an upward direction while pushing the sucker-rod limb with horsehead downward. Simple removal of power will allow the counterweight to lift the column of oil and the piston. It should be noted that on over counterweighted system is an unusual design. The under counterweighted system which is considerably more typical has a counterweight that less than compensates for the above weights on the sucker-rod limb, therefore, when power is removed the horsehead tends to move to a downward position with the counterweight high in the air.

A significant problem in the operation of oil pump jacks is that they tend to be located in remote areas and also tend not to be too close together thereby making the provision of power to operate the pump jacks somewhat of a problem. As was mentioned above, the typical pump motor is either a gasoline engine driven or electrically-driven motor. An electrically-driven motor can be operated by stringing power lines to each of the wells no matter how remote or by local storage batteries which would have to be recharged or renewed on a periodic basis. A gasoline engine requires the provision of gasoline to storage tanks immediately adjacent the engine on a periodic basis in order to maintain the power source. Oil directly from the well cannot generally be burned in a gasoline engine because of the many high burning hydrocarbons that will tend to plug manifolds and carburetors.

The use of the natural gas which is available in most wells in the midwest and in the southwest of the United States has been limited to high gas production wells which are utilized in interstate or intrastate gas pipelines. If quantities of gas are not available in sufficient quantities to make it practical to pipe to such pipelines such gas is merely vented to the atmosphere. In the state of Ohio, such gas is often simply vented to the atmosphere because there is no economic gain from utilizing such small quantities over the vast distances of piping that would be necessary in order to connect to main intrastate or interstate gas lines and the proximity of many gas wells in Ohio or oil wells with some gas production to mountainous areas of the state additionally add to the problems and cost of laying such pipelines for small quantities of gas.

SUMMARY OF THE INVENTION

Therefore, a primary aspect of the present invention is the provision of a pump jack with a motor powered by natural gas available at the well head.

An additional aspect of the present invention resides in the provision of a smooth non-shock type of pump action available because a compressed gas is used as opposed to a substantially incompressible hydraulic fluid.

Another aspect of the present invention is the improvement of a conventional rocker arm type pump jack by providing a pneumatic motor powered by natural gas available from the well head.

BRIEF DESCRIPTION OF THE DRAWINGS

FIG. 1 is an elevational view of a pump jack according to the present invention

FIG. 2 is a schematic flow diagram of a natural gas power source to a pump jack according to the present invention.

DETAILED DESCRIPTION OF THE INVENTION

FIG. 1 is a side elevation view of a pump jack according to the present invention. Rocker arm 10 is a rigid member and is divided by a pivotally mounted support member or post 50 at support pad 44 into two sections. The left-hand section is known as the sucker-rod limb of the rocker arm while the right-hand section is known as the drive limb of the rocker arm. The two limbs of the rocker arm will be separately described beginning with the sucker-rod limb.

The sucker-rod limb of the rocker arm is adjustable in length, the main rocker arm 10 being a larger diameter pipe section than the extensible portion 12 of the sucker-rod limb. Adjustment is made by moving slidably disposed extensible portion 12 within the larger diameter rocker arm 10, a bolt 20 is configured to lockably engage the smaller diameter extensible portion 12 by being threaded through a nut 22 which has been welded to pipe 10 and a hole drilled therethrough allowing bolt 20 to be retained within pipe 10 with the tip of said bolt 20 engaging the pipe of extensible portion 12 in a lock position to maintain it at a specifically desired distance of extension. Bolt 20 may be disengaged from the lock position to release pipe 12 for further slidable movement within pipe 10. Horsehead 16 is a device for maintaining the point of application of power vertically above the well 42 even during the rocker-type reciprocating action of the pump jack. The horsehead 16 may be adjusted in order to optimize the action in maintaining a truly vertical disposition of cable 36 to maintain it in alignment with the sucker rods 40 which extend down well 42. The adjustment is provided by a turn buckle 28 which is pivotally connected to both the horsehead and the extensible section of the sucker-rod limb 12, the pivot points being 30 and 32 respectively. Pivot point 32 being attached to an eye lug 34 which is fixedly attached to the extensible section of the sucker-rod limb 12. Completing the description of the sucker-rod limb the cable section 36 is attached to sucker rod 40 via attachment mechanism 38 again to maintain a truly vertical orientation of the sucker rod in the well and vertical application of the force via cables 36.

Looking now to the drive limb of the rocker arm, counterweight 18 is attached to slidably extensible pipe section 14 which is slidably disposed within rocker arm pipe 10 and is lockable by releasable lock mechanism bolt 24 and nut 26 similar to bolt 20 and nut 22 described at the sucker-rod limb. The slidably extensible section 14 may be adjusted in order to optimize the use of the existing size of a counterweight 18 allowing adjustment of the moment thereof. Additionally counterweight 18 may be adjusted in weight by adding metal pieces thereto although such an adding mechanism is not shown, such adjustment of the size of weight 18 is well known to those who are familiar with the art of counterweight pump jacks. The pump jack shown in FIG. 1 is an under-counterweighted pump jack, therefore, the moment about pivot point 48 on the vertical support stanchion 50 is such that when all power is removed from the system the sucker-rod limb will be downwardly disposed with the drive limb and counterweight 18 being disposed high in the air.

The rocker arm assembly 10 is pivotally attached to bearing block 46 via pivot point 48 and is supported by a support saddle 44 attached to the bearing 46. A stanchion 50 is reinforced with a gusset 52 in order to give stability in the horizontal as well as vertical direction. A post of this type is known as a Samson post. The entire stanchion assembly is located on base 54 which is a standard I-beam and steelplate constructed base designed to maintain the stanchion in a rigid vertical position and also to provide support for the drive mechanism stanchions 70. The support base 54 is also designed so that the entire pump jack may be lifted onto a truck bed and transported to a different well site if necessary and therefore has been designed sufficiently strong to be able to withstand the forces not only of the operation of the pump jack but also of moving such a heavy weight down a highway on a flatbed truck.

Turning now to a description of the power-drive system of the pumpjack which is best understood by referring to both FIG. 1 and FIG. 2 together. FIG. 2 being a schematic representation of the natural gas powered motor in a process and instrumentation type of diagram. Inasmuch as the drive system portion of FIG. 1 and the schematic representations of that same system in FIG. 2 describe the same major features, identical numeration has been utilized where appropriate to allow for immediate cross-reference between the schematic FIG. 2 and the structural representation in FIG. 1.

The drive system is supported on the base structure 54 by stanchion 70 and drives against the drive limb portion of the rocker arm at gusset plates 56 which are weldably attached to pipe section 10 of the rocker arm. Therefore the distance between the drive point of attachment of gusset plates 56 is constant with respect to the pivot point 48 along the pipe section 10 of the rocker arm. The drive limb is driven by a pneumatic motor which is more completely described by reference to its elements as follows: A pneumatic type cylinder 60 is pivotably fixed to stanchion base 70 by pivot point 66 which is a pivot pin inserted through holes in gusset plates 68 which are themselves physically attached to stanchion 70, allowing the cylinder base 60 to be able to rotate freely about point 66 in response to the changes in direction of the application of force against the gusset plates 56 during the reciprocating motion of the pump jack. Since the pump jack depicted is an undercounterweighted pump jack the force being applied at gusset plate 56 is a pulling motion tending to pull the drive limb of the rocker arm in a downward position thereby pulling the horsehead up and pulling the column of oil out of the well 42. Then by simply releasing the downward force that is being applied in cylinder 60, the horsehead by its own weight and by the weight of the column of oil will proceed back to the bottom of the well or to the bottom point of the piston/in the well. The downward motion in cylinder 60 is provided by piston 62 mounted within cylinder 60. The driving force of gas within the pneumatic cylinder is provided by gas emanating directly from well 42. The gas which normally exists within a well is extracted from the outer annulus of the well between the oil pipe in which the sucker rods operate and the well casing, via pipe 80. The gas pressure in pipe 80 found in many wells in the state of Ohio would typically be around 200 psig. This gas pressure is then regulated to a constant working pressure by regulator 82 which is a typical diaphragm type gas regulator with pressure indication gauge 84 attached thereto. Referring to FIG. 2, natural gas coming from pipe 80 passes through regulator 82 which is controlled by a downstream sensing line in order to maintain the diphragm opening of the regulator valve and also passes pressure indicating gauge 84 which gives a visual representation of the actual pressure being delivered to the drive system. In a standard diaphragm-type pressure regulator the downstream pressure in a flow condition may be manually adjusted by an adjustment screw on the regulator. The regulated gas then passes to solenoid-operated valve 78 which is a double-acting four-ported solenoid operated valve suitable for such service. One of the ports has been plugged utilizing therefore only three of the ports in this process control design. FIG. 2 shows solenoid valve 78 in its de-energized position, however, since it is a double-acting solenoid valve it does tend to fail as is. The de-energized position chosen was merely one of two positions of operability of a double-acting solenoid valve. In FIG. 2 solenoid valve 78 is shown passing pressure regulated natural gas from the well to the upper side of the piston 62 which resides within cylinder 60. This will produce power on the downstroke which as described above is the desired power direction of cylinder 60 because the subject pump jack is of the under counterweighted type. The lower portion of cylinder 60 is open to the atmosphere since this cylinder operates power only in the downstroke direction. Solenoid valve 78 is then switched electrically at the completion of the downstroke allowing the gas residing above piston 62 within cylinder 60 to be vented via line 64 to low-pressure natural gas line 90 which is available to carry low pressure but usable natural gas in a pure state to some other location within the field or to a commercial low-pressure natural gas line. Switching of the solenoid valve is accomplished by the electrical actuation of a limit switch 72 by two adjustable plate-type limits 74 and 76. Limit plate 74 upon striking limit switch 72 identifies the lower end of the stroke or the end of the power stroke. Limit switch 72 then transmits the electrical signal to the double-acting solenoid valve 78 to shift positions to vent the cylinder 60, thereby initiating a downstroke of the piston in the well. The downstroke is not powered, and is caused only by the under counterweighting condition of the pump jack. On the upstroke, limit 76 engages limit switch 72 again shifting the solenoid valve from the vent position to the power position. Solenoid valve 78 is mounted upon a bracket 88 which is located on the Samson post 50 in order to hold it in rigid relationship to the regulator and natural gas pipe 80. The regulated gas supply to solenoid valve 78 is pipe section 86 and the flexible hose section from limit switch 78 to the uppermost inlet port of pneumatic cylinder 60 is hose 64. Thus, the entire assembly including unregulated gas supply in pipe 80 all the way through to the vent to pipe 90 encompassing the limit switch assemblies, the cylinder 60, piston 62, the regulator and solenoid valve comprises a pneumatic motor that utilizes natural gas as the working fluid.

The operation of natural gas within such a pneumatic motor arrangement inherently tends to cushion the shock loads normally associated with mechanical motor type drive assemblies such as those normally encountered on such a reciprocating pump jack being driven via a rotating electrical or gasoline driven motor. The end of the stroke in the power direction is terminated by the limit switch prior to the piston bottoming out in cylinder 60 and the compressability of the natural gas tends to act as a cushion at the bottom of the cylinder, and since a pneumatic-type fluid, natural gas, is being utilized the rapid shifting of solenoid valve 78 does not produce a hammer or hydraulic lock-type situation but produces a smooth cushioned change of direction of the cylinder. Thereby, the momentum of piston 62 in either the upward or the downward direction tends to be cushioned by the compressible gas in the ends of cylinder 60 eliminating shock loading. Also, natural gas that is usually vented to the atmosphere and lost is utilized at least for its pressure but not for its fuel content at the local well.

It will be apparent to those skilled in the art that numerous changes and modifications may be made in the preferred embodiment of my invention described above. Accordingly, the foregoing description and drawings are to be construed as solely illustrative and not in a limitative sense, the scope of my invention being solely defined by the appended claims.

I claim:

1. A pump jack including in combination a mounting base having mounted thereon a support member, a rocker arm pivotally mounted on said support member, said rocker arm being divided by said pivotal mounting into a sucker rod limb and a drive limb, the sucker rod limb having a sucker rod attached to its end most remote from the pivotal mounting, and the drive limb having one end of a piston of a pneumatic motor pivotally attached thereto intermediate the pivotal mounting and the end of the drive limb remote from said mounting, said piston extending from a cylinder mounted on said mounting base, said sucker rod projecting into a well casing, gas under pressure exiting from said casing, means for delivering said exiting gas to said cylinder to drive said piston in one direction, switch means for opening and closing the cylinder to the gas to thereby reciprocate the piston within the cylinder and pivot the rocker arm about said pivotal mounting, means for adjusting the length of the stroke of said piston, two means for adjusting the length of the sucker rod limb without changing the length of the drive limb, means for adjusting the length of the drive limb without changing the length of the sucker rod limb.

2. The combination of claim 1 including a curved surface pivotally joined to the end of the sucker rod limb remote from said pivotal mounting, said curved surface being mounted to support the sucker rod, means for pivoting the curved surface around where it is joined to said sucker rod limb and locking it in place, said means for pivoting the curved surface being one of said means for adjusting the length of the sucker rod limb.

3. The combination of claim 2 wherein one of said means for adjusting the length of said sucker rod limb of said rocker arm comprises a first inner section, a second outer section slideable relative to said first section along the length of said rocker arm and locking means for releasably locking said second section in a fixed position relative to said section.

4. The combination of claim 3 wherein one end of the cylinder is always open to atmospheric pressure.

5. The combination of claim 4 wherein the length of said stroke is adjustable by means of limit switch and solenoid valve controlled operation.

6. The combination of claim 5 wherein said stroke length is adjusted to eliminate shock loading at the uppermost and lowermost points of the stroke of said pneumatic cylinder.

7. The combination of claim 1 wherein one of said means for adjusting the length of said sucker rod limb of said rocker arm comprises a first inner section, a second outer section slideable relative to said first section along the length of said rocker arm and locking means for releasably locking said second section in a fixed position relative to said section.

8. A pump jack according to claim 1 wherein said drive limb of said rocker arm comprises a first inner section, a second outer section slideable relative to said first section along the length of said rocker arm and locking means for releasably locking said second section in a fixed position relative to said first section.

9. A pump jack according to claim 8 wherein said first section has the form of a hollow cylinder, said second section has the form of a cylinder slideably disposed within the hollow interiors of said first section and said locking means, when locked extend through the wall of said first section and engage the cylindrical surface of said second section thereby locking said two sections in position relative to one another.

10. An apparatus according to claim 1 including means for regulating the pressure of said gas.

11. An apparatus according to claim 10 including means for venting said gas to a low-pressure gasline.

12. An apparatus according to claim 1 wherein the length of said stroke is adjustable by means of limit switch and solenoid valve controlled operation.

13. An apparatus according to claim 12 wherein said stroke length is adjusted to eliminate shock loading at the uppermost and lowermost points of the stroke of said pneumatic cylinder.

* * * * *